US009733001B2

(12) United States Patent
Lim et al.

(10) Patent No.: US 9,733,001 B2
(45) Date of Patent: Aug. 15, 2017

(54) MULTI TYPE AIR CONDITIONER AND COOLING AND HEATING CONTROL METHOD THEREOF

(71) Applicant: Samsung Electronics Co., Ltd., Suwon-si (KR)

(72) Inventors: Byoung Guk Lim, Suwon-si (KR); Kyoung Rock Kim, Suwon-si (KR); Kyung Hoon Kim, Yongin-si (KR); Suk Ho Lee, Suwon-si (KR); Min Chang, Suwon-si (KR); Cha Wang Jang, Suwon-si (KR); Dong Ii Jung, Suwon-si (KR); Ii Yong Cho, Suwon-si (KR); Tae Hoon Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1048 days.

(21) Appl. No.: 13/899,104

(22) Filed: May 21, 2013

(65) Prior Publication Data

US 2013/0319018 A1 Dec. 5, 2013

(30) Foreign Application Priority Data

May 30, 2012 (KR) ..... 10-2012-0057801

(51) Int. Cl.

| | |
|---|---|
| ***F25B 49/02*** | (2006.01) |
| ***F25B 13/00*** | (2006.01) |
| ***F24F 3/06*** | (2006.01) |
| ***F24F 11/00*** | (2006.01) |

(52) U.S. Cl.

CPC ..... *F25B 49/022* (2013.01); *F24F 3/065* (2013.01); *F24F 11/001* (2013.01); *F24F 11/006* (2013.01); *F25B 13/00* (2013.01); *F25B 49/027* (2013.01); *F24F 2011/0075* (2013.01); *F25B 2313/023* (2013.01); *F25B 2313/02741* (2013.01); *F25B 2600/027* (2013.01)

(58) Field of Classification Search

CPC ..... F24F 2011/0075; F25B 2313/023; F25B 2313/0233; F25B 2500/18; F25B 2600/02; F25B 2600/027; F25B 2600/0271; F25B 2600/0272

See application file for complete search history.

(56) References Cited

U.S. PATENT DOCUMENTS

2010/0241287 A1* 9/2010 Nishino ..... F24F 3/065 700/300

* cited by examiner

*Primary Examiner* — Jonathan Bradford
(74) *Attorney, Agent, or Firm* — Staas & Halsey LLP

(57) ABSTRACT

A cooling and heating control method of a multi type air conditioner in which a target pressure of a compressor is adjusted based on conditions of respective indoor units so as to reduce power consumption is provided. The cooling control method includes determining the indoor unit desired to execute power saving control, judging whether or not a difference between a temperature of a space in which the indoor unit desired to execute power saving control is located and a set temperature of the indoor unit is less than a reference value, raising a target evaporation temperature of the indoor unit upon judging that the difference is less than the reference value, comparing an evaporation temperature of the indoor unit with the raised target evaporation temperature, and raising an evaporation pressure of a compressor, when the evaporation temperature of the indoor unit is lower than the raised target evaporation temperature.

7 Claims, 8 Drawing Sheets

MULTI TYPE AIR CONDITIONER AND COOLING AND HEATING CONTROL METHOD THEREOF

CROSS-REFERENCE TO RELATED APPLICATIONS

This application claims the priority benefit of Korean Patent Application No. 10-2012-0057801, filed on May 30, 2012 in the Korean Intellectual Property Office, the disclosure of which is incorporated herein by reference.

BACKGROUND

1. Field

Embodiments relate to a multi type air conditioner having a plurality of indoor units and a power saving control method of cooling and heating operations thereof.

2. Description of the Related Art

In general, an air conditioner includes one outdoor unit and one indoor unit connected to each other. However, a multi type air conditioner in which a plurality of indoor units is connected to a large-capacity outdoor unit to independently cool and heat separate spaces, such as in a building or a school, has been developed and spread.

In such a multi type air conditioner in which plural indoor units are connected to one outdoor unit, the outdoor unit includes a compressor, a four-way valve, an outdoor heat exchanger, an outdoor fan and an electromotive expansion valve, and each indoor unit includes an indoor fan and an indoor heat exchanger.

If the multi type air conditioner executes a cooling operation, a refrigerant in a high-temperature and high-pressure state discharged from the compressor passes through the four-way valve, the outdoor heat exchanger and the electromotive expansion valve, and is then introduced back into the compressor via the indoor heat exchangers, and if the multi type air conditioner executes a heating operation, the refrigerant in the high-temperature and high-pressure state discharged from the compressor passes through the four-way valve, the indoor heat exchangers and the electromotive expansion valve, and is then introduced back into the compressor via the outdoor heat exchanger.

Recently, requirements for energy saving increase due to increase of power consumption, and many regulations for energy saving are enforced.

In the case of a single type air conditioner in which one indoor unit is connected to one outdoor unit, when an indoor temperature reaches a temperature set by a consumer, the capacity of a compressor may be decreased to minimize power consumption. That is, the capacity of the compressor may be changed using a difference between the set temperature and the indoor temperature and a change thereof as input, and thus power consumption may be reduced.

However, in the case of the multi type air conditioner, since the plural indoor units are provided and the set temperatures of the respective indoor units are different, it may be difficult to control the multi type air conditioner in the same manner as the single type air conditioner.

SUMMARY

In an aspect of one or more embodiments, there is provided a cooling and heating control method of a multi type air conditioner in which a target pressure of a compressor is adjusted based on conditions of respective indoor units so as to reduce power consumption.

In an aspect of one or more embodiments, there is provided a cooling control method of a multi type air conditioner including a compressor and plural indoor units includes determining the indoor unit desired to execute power saving control among the plural indoor units, judging whether or not a difference between a temperature of a space in which the indoor unit desired to execute power saving control is located and a set temperature of the indoor unit desired to execute power saving control is less than a reference value, when the indoor unit desired to execute power saving control is determined, raising a target evaporation temperature of the indoor unit desired to execute power saving control upon judging that the difference is less than the reference value, comparing an evaporation temperature of the indoor unit desired to execute power saving control with the raised target evaporation temperature, and raising an evaporation pressure of the compressor, when the evaporation temperature of the indoor unit desired to execute power saving control is lower than the raised target evaporation temperature.

The multi type air conditioner may further include an input unit receiving user instructions, and the determination of the indoor unit desired to execute power saving control among the plural indoor units may include determining the indoor unit desired to execute power saving control among the plural indoor units according to the user instructions, when the user instructions are input through the input unit.

The input unit may include a wired or wireless remote controller, a computer loaded with a program for controlling operation of the multi type air conditioner, or a smartphone or a tablet PC loaded with an application for controlling operation of the multi type air conditioner.

The target evaporation temperature of the indoor unit desired to execute power saving control may be set to plural stages, each of which has a predetermined temperature range, and is then stored.

The raising of the target evaporation temperature of the indoor unit desired to execute power saving control upon judging that the difference is less than the reference value may include raising the stage of the target evaporation temperature of the indoor unit desired to execute power saving control upon judging that the difference is less than the reference value.

The cooling control method may further include lowering the evaporation pressure of the compressor, when the evaporation temperature of the indoor unit desired to execute power saving control is higher than the raised target evaporation temperature.

The comparison of the evaporation temperature of the indoor unit desired to execute power saving control with the raised target evaporation temperature may include comparing the evaporation temperature of the indoor unit desired to execute power saving control with the raised target evaporation temperature at intervals of a predetermined period.

In an aspect of one or more embodiments, there is provided a heating control method of a multi type air conditioner including a compressor and plural indoor units includes determining the indoor unit desired to execute power saving control among the plural indoor units, judging whether or not a difference between a temperature of a space in which the indoor unit desired to execute power saving control is located and a set temperature of the indoor unit desired to execute power saving control is less than a reference value, when the indoor unit desired to execute power saving control is determined, and lowering a condensation pressure of the compressor upon judging that the difference is less than the reference value.

The multi type air conditioner may further include an input unit receiving user instructions, and the determination of the indoor unit desired to execute power saving control among the plural indoor units may include determining the indoor unit desired to execute power saving control among the plural indoor units according to the user instructions, when the user instructions are input through the input unit.

The input unit may include a wired or wireless remote controller, a computer loaded with a program for controlling operation of the multi type air conditioner, or a smartphone or a tablet PC loaded with an application for controlling operation of the multi type air conditioner.

The lowering of the condensation pressure of the compressor upon judging that the difference is less than the reference value may include lowering a target condensation temperature of the indoor unit desired to execute power saving control upon judging that the difference is less than the reference value, comparing a condensation temperature of the indoor unit desired to execute power saving control with the lowered target condensation temperature, and lowering the condensation pressure of the compressor, when the condensation temperature of the indoor unit desired to execute power saving control is higher than the lowered target condensation temperature.

The heating control method may further include raising the condensation pressure of the compressor, when the condensation temperature of the indoor unit desired to execute power saving control is lower than the lowered target condensation temperature.

The comparison of the condensation temperature of the indoor unit desired to execute power saving control with the lowered target condensation temperature may include comparing the condensation temperature of the indoor unit desired to execute power saving control with the lowered target condensation temperature at intervals of a predetermined period.

In an aspect of one or more embodiments, there is provided a multi type air conditioner includes plural indoor units, a compressor compressing a refrigerant supplied to the plural indoor units, and a controller determining the indoor unit desired to execute power saving control among the plural indoor units, judging whether or not a difference between a temperature of a space in which the indoor unit desired to execute power saving control is located and a set temperature of the indoor unit desired to execute power saving control is less than a reference value, when the indoor unit desired to execute power saving control is determined, raising a target evaporation temperature of the indoor unit desired to execute power saving control upon judging that the difference is less than the reference value, comparing an evaporation temperature of the indoor unit desired to execute power saving control with the raised target evaporation temperature, and raising an evaporation pressure of the compressor, when the evaporation temperature of the indoor unit desired to execute power saving control is lower than the raised target evaporation temperature.

The multi type air conditioner may further include an input unit receiving user instructions, and the controller may determine the indoor unit desired to execute power saving control among the plural indoor units according to the user instructions, when the user instructions are input through the input unit.

The input unit may include a wired or wireless remote controller, a computer loaded with a program for controlling operation of the multi type air conditioner, or a smartphone or a tablet PC loaded with an application for controlling operation of the multi type air conditioner.

The target evaporation temperature of the indoor unit desired to execute power saving control may be set to plural stages, each of which has a predetermined temperature range, and then be stored.

The controller may raise the stage of the target evaporation temperature of the indoor unit desired to execute power saving control upon judging that the difference is less than the reference value.

The controller may lower the evaporation pressure of the compressor, when the evaporation temperature of the indoor unit desired to execute power saving control is higher than the raised target evaporation temperature.

The controller may compare the evaporation temperature of the indoor unit desired to execute power saving control with the raised target evaporation temperature at intervals of a predetermined period.

In an aspect of one or more embodiments, there is provided a multi type air conditioner includes plural indoor units, a compressor compressing a refrigerant supplied to the plural indoor units, and a controller determining the indoor unit desired to execute power saving control among the plural indoor units, judging whether or not a difference between a temperature of a space in which the indoor unit desired to execute power saving control is located and a set temperature of the indoor unit desired to execute power saving control is less than a reference value, when the indoor unit desired to execute power saving control is determined, and lowering a condensation pressure of the compressor upon judging that the difference is less than the reference value.

The multi type air conditioner may further include an input unit receiving user instructions, and the controller may determine the indoor unit desired to execute power saving control among the plural indoor units according to the user instructions, when the user instructions are input through the input unit.

The input unit may include a wired or wireless remote controller, a computer loaded with a program for controlling operation of the multi type air conditioner, or a smartphone or a tablet PC loaded with an application for controlling operation of the multi type air conditioner.

The controller may lower a target condensation temperature of the indoor unit desired to execute power saving control upon judging that the difference is less than the reference value, compare a condensation temperature of the indoor unit desired to execute power saving control with the lowered target condensation temperature, and lower the condensation pressure of the compressor, when the condensation temperature of the indoor unit desired to execute power saving control is higher than the lowered target condensation temperature.

The controller may raise the condensation pressure of the compressor, when the condensation temperature of the indoor unit desired to execute power saving control is lower than the lowered target condensation temperature.

The controller may compare the condensation temperature of the indoor unit desired to execute power saving control with the lowered target condensation temperature at intervals of a predetermined period.

In an aspect of one or more embodiments, there is provided a cooling control method of a multi type air conditioning system including a compressor and plural indoor units, the cooling control method including identifying, using an input unit, one of the plural indoor units to execute power saving control among a plurality of units; raising a target evaporation temperature of the identified indoor unit to execute power saving control if the difference between a set temperature of the indoor unit and current temperature of the space associated with the identified indoor unit is less than a reference value; and raising an evaporation pressure of the compressor, when the evaporation temperature of the identified indoor unit is lower than the raised target evaporation temperature.

The input unit may include a wired or wireless remote controller, a computer loaded with a program for controlling operation of the multi type air conditioner, or a smartphone or a tablet personal computer (PC) loaded with an application for controlling operation of the multi type air conditioner.

BRIEF DESCRIPTION OF THE DRAWINGS

These and/or other aspects will become apparent and more readily appreciated from the following description, taken in conjunction with the accompanying drawings of which.

DETAILED DESCRIPTION

Figure 1:
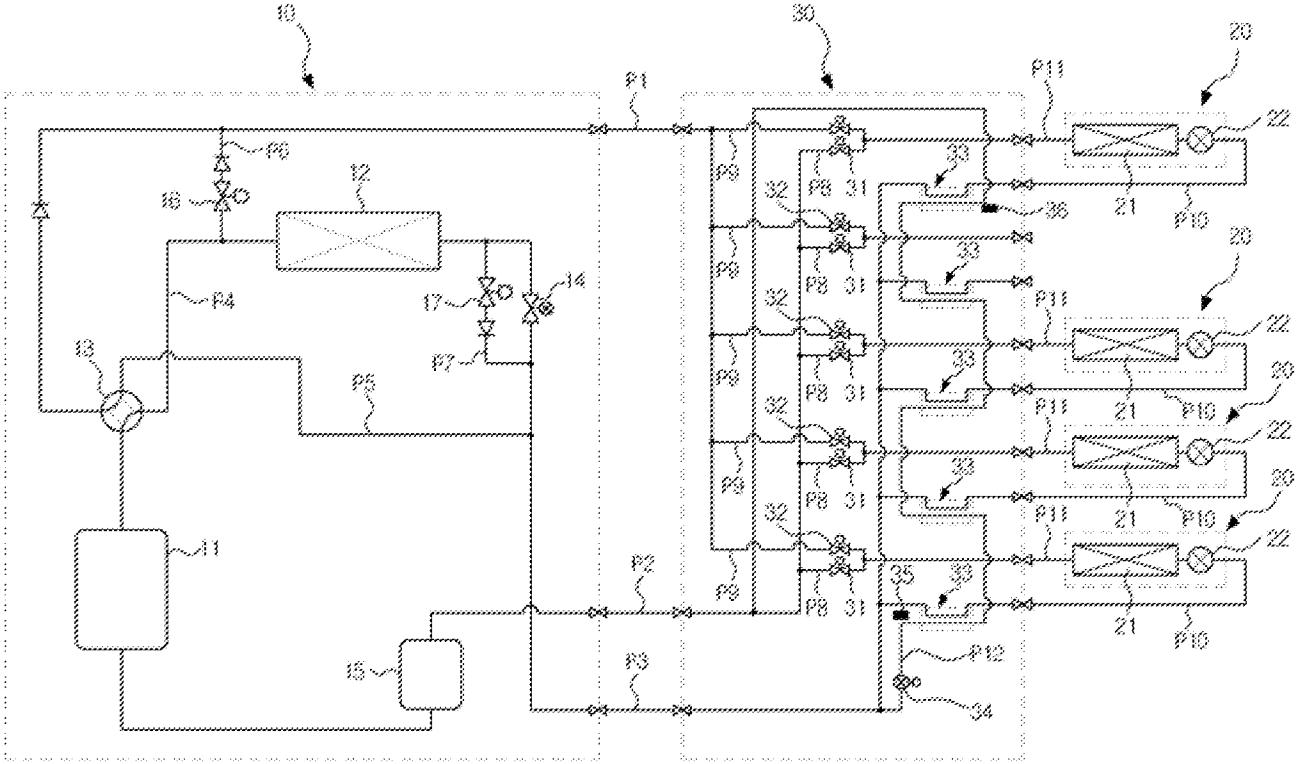
FIG. 1 is a schematic view of a multi type air conditioner in accordance with an embodiment.

Reference will now be made in detail to embodiments, examples of which are illustrated in the accompanying drawings, wherein like reference numerals refer to like elements throughout.

A multi type air conditioner in accordance with an embodiment, as shown in FIG. 1, includes an outdoor unit 10 disposed in an outdoor space, plural indoor units 20 respectively disposed in plural indoor spaces and independently cooling and heating the respective indoor spaces, and a mode conversion unit 30 disposed between the outdoor unit 10 and the plural indoor units 20, respectively connected to the outdoor unit 10 and the plural indoor units 20 through refrigerant pipes and transmitting a refrigerant transmitted from one of the outdoor unit 10 and the plural indoor units 20 to the other of the outdoor unit 10 and the plural indoor units 20 to cause the plural indoor units 20 to selectively execute cooling or heating.

The outdoor unit 10 includes a compressor 11 compressing the refrigerant, an outdoor heat exchanger 12 exchanging heat with outdoor air, a four-way valve 13 guiding the refrigerant discharged from the compressor 11 to one of the outdoor unit 10 and the indoor units 20, an outdoor expansion valve 14 decompressing and expanding the refrigerant guided to the outdoor heat exchanger 12 during heating, and a gas-liquid separator 15 preventing flow of the refrigerant in a gaseous state into the compressor 11. Each of the plural indoor units 20 includes an indoor heat exchanger 21 exchanging heat with indoor air, and an indoor expansion valve 22 decompressing and expanding the refrigerant guided to the indoor heat exchanger 21 during cooling.

The outdoor expansion valve 14 and the indoor expansion valves 22 are electronic expansion valves, the degree of opening of which is adjustable, so as to selectively decompress and expand the refrigerant passing through the outdoor expansion valve 14 and the indoor expansion valves 22.

These respective constituent elements may be connected through refrigerant pipes so that the refrigerant may circulate through the constituent elements. The refrigerant pipes include a first refrigerant pipe P1 connecting the four-way valve 13 and the indoor heat exchangers 21 and transmitting the refrigerant of a high temperature discharged from the compressor 11 to the indoor heat exchangers 21, a second refrigerant pipe P2 connecting the indoor heat exchangers 21 and the compressor 11 and guiding the refrigerant absorbing heat in the indoor heat exchangers 21 to the compressor 11 during cooling, a third refrigerant pipe P3 connecting the outdoor heat exchanger 12 and the indoor heat exchangers 21 and guiding the refrigerant emitting heat to one of the outdoor heat exchanger 12 and the indoor heat exchangers 21 to the other of the outdoor heat exchanger 12 and the indoor heat exchangers 21, a fourth refrigerant pipe P4 connecting the four-way valve 13 and the outdoor heat exchanger 12 and transmitting the refrigerant of the high temperature to the outdoor heat exchanger 12, and a fifth refrigerant pipe P5 connecting the four-way valve 13 and the third refrigerant pipe P3 and guiding the refrigerant transmitted from the outdoor heat exchanger 12 through the four-way valve 13 to the compressor 11 through the third refrigerant pipe P3 during heating.

A heating bypass refrigerant pipe P6 connecting the first refrigerant pipe P1 and the fourth refrigerant pipe P4 and transmitting a part of the refrigerant transmitted to the outdoor heat exchanger 12 through the fourth refrigerant pipe P4 to a specific indoor heat exchanger 21 through the first refrigerant pipe P1 so that the corresponding indoor heat exchanger 21 may execute heating, if heating of a smaller load than cooling load is executed, is further provided between the first refrigerant pipe P1 and the fourth refrigerant pipe P4, and a heating bypass valve 16 opening and closing the heating bypass refrigerant pipe P6 is disposed on the heating bypass refrigerant pipe P6.

The above-described outdoor expansion valve 14 is disposed on the third refrigerant pipe P3. The refrigerant pipes further include a cooling bypass refrigerant pipe P7 causing the refrigerant to bypass the outdoor expansion valve 14 during cooling, and a cooling bypass valve 17 opening and closing the cooling bypass refrigerant pipe P7 is disposed on the cooling bypass refrigerant pipe P7.

The mode conversion unit 30 includes plural cooling refrigerant pipes P8 connecting the second refrigerant pipe P2 to the plural indoor heat exchangers 21 so as to transmit the refrigerant, having passed through the indoor heat exchangers 21, to the compressor 11 through the second refrigerant pipe P2 during cooling, plural heating refrigerant pipe P9 connecting the first refrigerant pipe P1 to the plural indoor heat exchangers 21 so as to transmit the refrigerant, transmitted from the compressor 11 through the first refrigerant pipe P1, to the indoor heat exchangers 21 during heating, cooling valves 31 respectively disposed on the plural cooling refrigerant pipes P8 so as to cause the corresponding indoor units 20 to selectively execute cooling, and heating valves 32 respectively disposed on the plural heating refrigerant pipes P9 so as to cause the corresponding indoor units 20 to selectively execute heating. A pair of one cooling valve 31 and one heating valve 32 is connected to one indoor unit 20, and thus plural pairs of cooling valves 31 and heating valves 32 corresponding to the plural indoor units 20 are provided.

The refrigerant pipes further include plural first branch refrigerant pipes P10 branching from the third refrigerant pipe P3 so as to supply the refrigerant to the plural indoor heat exchangers 21 during cooling, and plural second branch refrigerant pipes P11 connecting the plural indoor heat exchangers 21 to the corresponding cooling refrigerant pipes P8 and heating refrigerant pipes P9. The above-described indoor expansion valves 22 are disposed on the first branch refrigerant pipes P10.

The mode conversion unit 30 further includes supercooling units 33 supercooling the refrigerant transmitted from the outdoor heat exchanger 12 prior to flow into the indoor units 20 during cooling so as to prevent flow of the refrigerant in the gaseous state into the indoor expansion valves 22.

Plural supercooling units 33 are provided so as to respectively supercool the refrigerant flowing into the plural indoor units 20, and supercool the refrigerant passing through the first branch refrigerant pipes P10. The mode conversion unit 30 further includes a supercooling refrigerant pipe P12 branching from the third refrigerant pipe P3 to cool the refrigerant passing through the first branch refrigerant pipes P10 in the supercooling units 33 and joining the second refrigerant pipe P2 after passing through the supercooling units 33, and a supercooling expansion valve 34 disposed on the supercooling refrigerant pipe P12 so as to decompress and expand the refrigerant prior to flow into the supercooling units 33. That is, since the first branch refrigerant pipe P10 and the supercooling refrigerant pipe P12 exchange heat with each other in the supercooling unit 33, the refrigerant passing through the first branch refrigerant pipe P10 is supercooled by the refrigerant passing through the supercooling refrigerant pipe P12, and the refrigerant passing through the supercooling refrigerant pipe P12 is heated by the refrigerant passing through the first branch refrigerant pipe P10.

Therefore, the refrigerant transmitted from the outdoor heat exchanger 12 is decompressed and expanded while passing through the supercooling expansion valve 34, and the decompressed and expanded refrigerant absorbs heat from the refrigerant passing through the first branch refrigerant pipes P10 while passing through the supercooling units 11 along the supercooling refrigerant pipe P12. Therefore, the refrigerant passing through the first branch refrigerant pipes P10 is supercooled by the supercooling units 33 prior to flow into the indoor expansion valves 22 of the indoor units 20.

In an embodiment, the supercooling refrigerant pipe P12 is configured to sequentially pass through the plural supercooling units 33 and to supercool all the refrigerants flowing into the respective indoor units 20. If the supercooling refrigerant pipe P12 sequentially passes through the plural supercooling units 33, when some indoor units 20 are stopped, heat exchange in the supercooling unit 33 corresponding to the stopped indoor unit 20 is not executed, and the refrigerant is transmitted to the next supercooling unit 33 along the supercooling refrigerant pipe P12 and is used to absorb heat of the refrigerant passing through the first branch refrigerant pipe P10 in the next supercooling unit 33. Therefore, the refrigerant absorbing heat in the supercooling units 33 corresponding to the stopped indoor units 20 is removed, and thus efficiency of the multi type air conditioner may be improved.

Further, the mode conversion unit 30 includes temperature sensors measuring the temperatures of the refrigerant passing through the supercooling units 33. In this embodiment, the temperature sensors include a first temperature sensor 35 measuring the temperature of the refrigerant flowing into the supercooling unit 33 at the uppermost stream of the supercooling refrigerant pipe P12 among the plural supercooling units 33, and a second temperature sensor 36 measuring the temperature of the refrigerant discharged from the supercooling unit 33 at the lowermost stream of the supercooling refrigerant pipe P12 among the plural supercooling units 33. Therefore, whether or not the refrigerant is in a state in which liquid and gas are mixed with each other or in a pure gaseous state is judged by measuring the temperatures of the refrigerant passing through the supercooling refrigerant pipe P12 through the first temperature sensor 35 and the second temperature sensor 36, and thereby, the opening degree of the supercooling expansion valve 34 is adjusted to prevent flow of the refrigerant in a liquid state into the compressor 11. Therefore, a difficulty in overheating of the refrigerant having passed through the superheating units 33 to the pure gaseous state may be prevented, and supercooling degrees required by the respective indoor units 20 may be assured.

Figure 2:
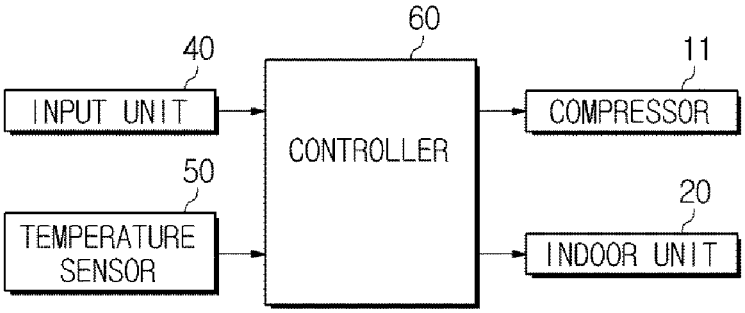
FIG. 2 is a block diagram illustrating the configuration for power saving control of the multi type air conditioner in accordance with the embodiment of the present invention.
Figure 3:
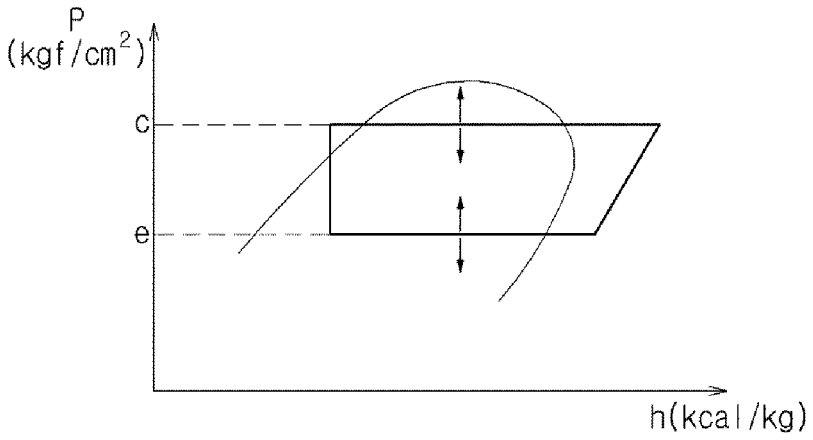
FIG. 3 is a p-h diagram of the multi type air conditioner in an embodiment.

FIG. 2 is a block diagram illustrating the configuration for power saving control of the multi type air conditioner in an embodiment, and FIG. 3 is a p-h diagram of the multi type air conditioner in an embodiment.

The multi type air conditioner in an embodiment includes an input unit 40 to which user instructions are input, temperature sensors 50 sensing the temperatures of spaces in which the indoor units 20 are present, the compressor 11 provided on the outdoor unit disposed in the outdoor space and the plural indoor units 20 respectively disposed in the plural indoor spaces and independently cooling and heating the respective indoor spaces, as shown in FIG. 1, and a controller 60 outputting a control signal for power saving control based on information received from the input unit 40 and the temperature sensors 50.

A user may select the indoor unit 20 desired to execute power saving control from the plural indoor units 20 through the input unit 40.

In the case of the indoor unit 20 installed in a space frequently contacting external air, such as a passage, a lobby or a toilet, it is not easy to cause the indoor temperature to approach a set temperature due to spatial characteristics thereof. Therefore, in order to cause the indoor temperature to approach the set temperature, cooling or heating may be continuously executed.

Therefore, as the indoor unit 20 desired to execute power saving, an indoor unit 20 installed in a space, such as an office or a classroom, other than the above-described space, such as a passage, a lobby or a toilet, may be selected.

The user may select such an indoor unit 20 desired to execute power saving control through the input unit 40. Here, the input unit 40 may include a wired or wireless remote controller, a computer loaded with a program for controlling operation of the multi type air conditioner, or a smartphone or a tablet PC loaded with an application for controlling operation of the multi type air conditioner.

Figure 4:
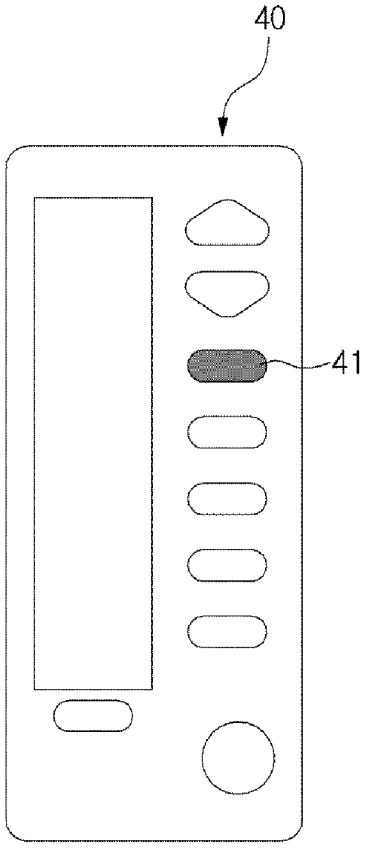
FIGS. 4 to 6 are views illustrating examples of an input unit of the multi type air conditioner in an embodiment.
Figure 5:
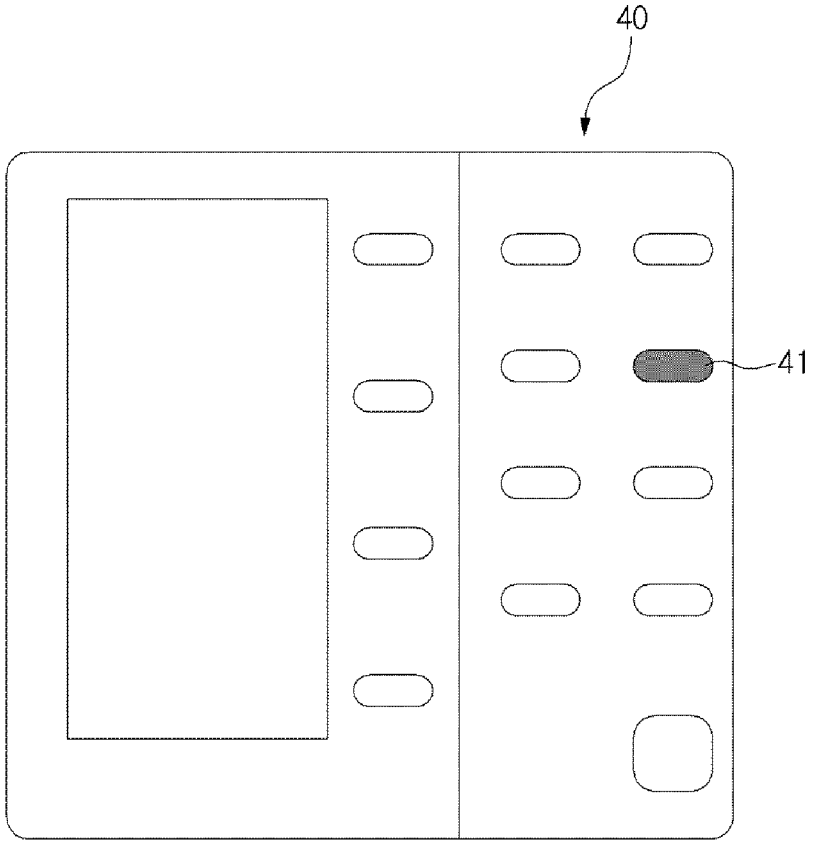

FIG. 4 is a view schematically illustrating a wireless remote controller, and FIG. 5 is a view schematically illustrating a wired remote controller. A power saving button 41 to execute power saving control may be provided on the wired and wireless remote controllers, and the user may execute power saving control, such as selection of an indoor unit desired to execute power saving control, through the power saving button 41.

Figure 6:
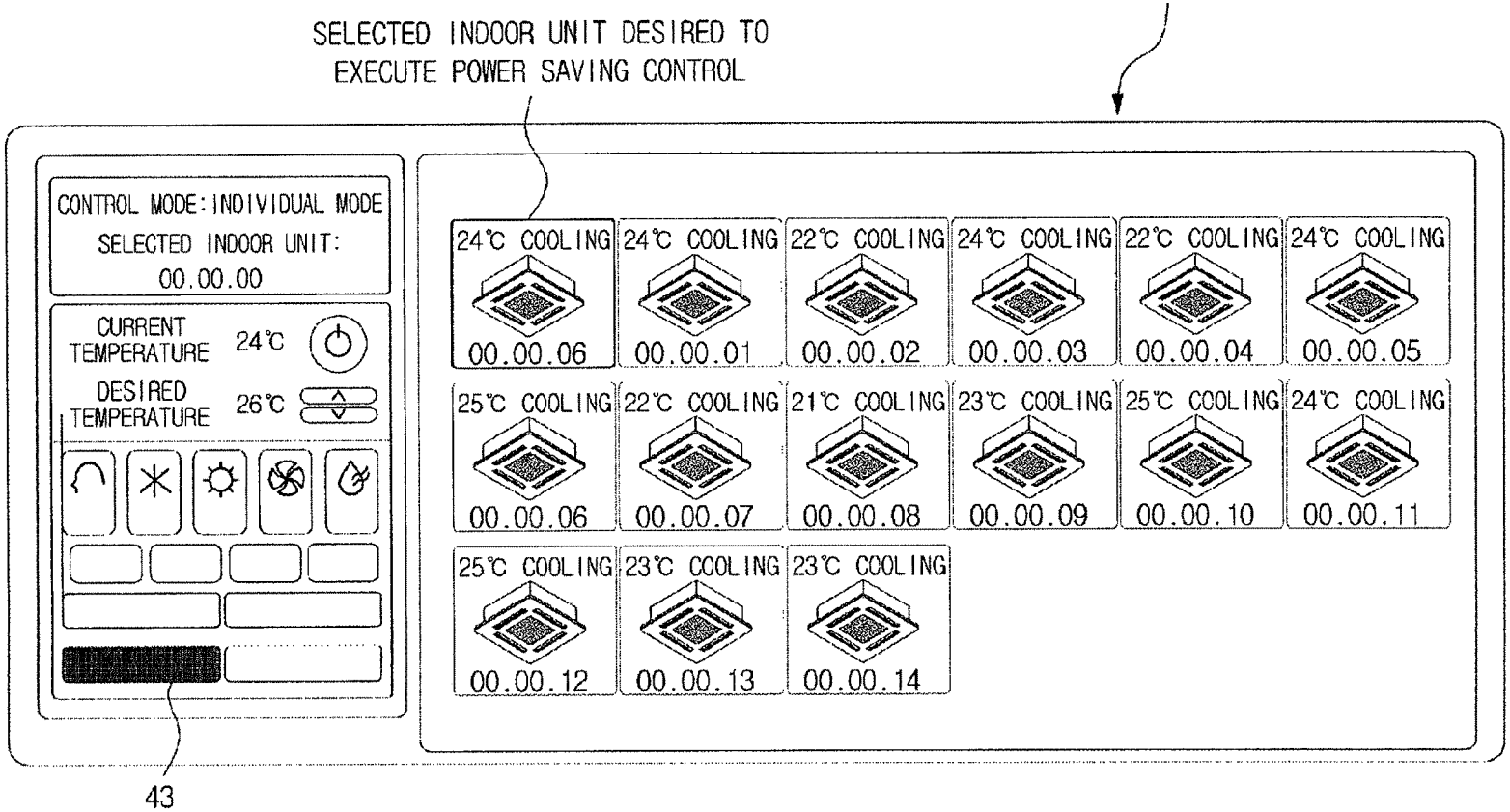

FIG. 6 illustrates an interface 42 to control the overall operation of the multi type air conditioner including power saving control provided to a user through a program or an application loaded on a computer, a smartphone or a tablet PC. The interface 42 may include plural windows executing various functions and showing results thereby. As shown in FIG. 6, a power saving button 43 to execute power saving control may be provided on the interface 42, and an indoor unit desired to execute power saving control may be selected among the plural indoor units through the power saving button 43.

Such selection of the indoor unit 20 desired to execute power saving control may be achieved by the controller 60. For example, the controller 60 may divide the indoor units 20 into the indoor units 20 requiring continuous cooling and heating and the indoor unit 20 not influencing cooling and heating even if power saving control is executed, based on speeds at which the indoor temperatures reach set temperatures or whether or not the indoor temperatures reach the set temperatures, and thus select the indoor unit 20 desired to execute power saving control.

The temperature sensors 50 are sensors sensing the temperatures of the indoor spaces in which the indoor units 20 are installed, and may be installed on the indoor units 20.

When user instructions regarding the indoor unit 20 desired to execute power saving control among the plural indoor units 20 are input through the input unit 40, the controller 60 determines the indoor unit 20 desired to execute power saving control according to such instructions. Otherwise, as described above, the controller 60 determines the indoor unit 20 desired to execute power saving control without user instructions transmitted from the input unit 40. Here, the controller 60 is a microcomputer mounted on the outdoor unit 10 or the indoor units 20 and controlling operation of the respective parts of the multi type air conditioner.

When the indoor unit 20 desired to execute power saving control is determined, the controller 60 executes power saving control upon the corresponding indoor unit 20.

First, the controller 60 judges whether or not a difference between a temperature of the space in which the indoor unit 20 desired to execute power saving control is installed, output from the temperature sensor 50 and a set temperature of the indoor unit 20 desired to execute power saving control is less than a reference value.

Since, if cooling is underway, the indoor temperature is generally higher than the set temperature, the controller 60 judges whether or not a value obtained by subtracting the set temperature from the indoor temperature is less than the reference value. Here, the reference value is a value to judge an approximation degree of the indoor temperature to the set temperature, and for example, may be set to about 3° C.

If the difference between the indoor temperature and the set temperature is less than the reference value, the controller 60 raises a target evaporation temperature of the indoor unit 20 desired to execute power saving control. In more detail, the controller 60 raises the target evaporation temperature of the indoor heat exchanger provided at the indoor unit 20. Here, the target evaporation temperature may be set to plural stages, each of which has a predetermined temperature range, and be stored. For example, 5~7° C. may be set to a first-stage temperature range, 7~9° C. may be set to a second-stage temperature range, 9~11° C. may be set to a third-stage temperature range, 11~13° C. may be set to a fourth-stage temperature range, and the target evaporation temperature may be raised by raising the set stage.

When the target evaporation temperature is raised, the controller 60 judges whether or not the evaporation temperature of the indoor unit 20 is lower than the raised target evaporation temperature by comparing the evaporation temperature of the indoor unit 20 with the raised target evaporation temperature.

If the evaporation temperature of the indoor unit 20 is lower than the raised target evaporation temperature, the controller 60 raises the evaporation pressure e of the compressor 11, as shown in FIG. 3, and thus reduces the capacity of the compressor 11 (with reference to FIG. 3) and reduces power consumption required to drive the compressor 11.

That is, when the difference between the indoor temperature and the set temperature is less than the reference value, the indoor temperature normally approximates the set temperature, and thus it may be understood that little difference of comfortableness is felt by the user even if power consumption required in cooling is reduced so as to more weakly execute cooling.

Therefore, the target evaporation temperature of the indoor unit 20 is raised, and the evaporation pressure e of the compressor 11 is adjusted by comparing the evaporation temperature of the indoor unit 20 with the raised target evaporation temperature, thereby reducing power consumption required to drive the compressor 11.

When the evaporation temperature of the indoor unit 20 is lower than the raised target evaporation temperature, in order to match the evaporation temperature of the indoor unit 20 with the target evaporation temperature, the capacity of the compressor 11 is reduced by raising the evaporation pressure e of the compressor 11. When the capacity of the compressor 11 is reduced in such a manner, power consumption required to drive the compressor 11 is reduced, and thus power saving effects may be obtained.

Further, when the evaporation temperature of the indoor unit 20 is higher than the raised target evaporation temperature, also in order to match the evaporation temperature of the indoor unit 20 with the target evaporation temperature, the capacity of the compressor 11 is increased by lowering the evaporation pressure e of the compressor 11, as shown in FIG. 3.

That is, the raised target evaporation temperature serves as a reference to select priority among power saving and user comfortableness. When the evaporation temperature of the indoor unit 20 is lower than the target evaporation temperature, it is judged that this situation requires power saving, and thus the capacity of the compressor 11 is reduced by raising the evaporation pressure e of the compressor 11 and power saving effects are obtained, and when the evaporation temperature of the indoor unit 20 is higher than the target evaporation temperature, it is judged that this situation influences user comfortableness, and thus the capacity of the compressor 11 is increased by lowering the evaporation pressure e of the compressor 11 and user comfortableness is maintained.

The above description relates to power saving control of the indoor unit 20 during the cooling operation. Hereinafter, power saving control of the indoor unit 20 during the heating operation will be described.

Determination of the indoor unit 20 desired to execute power saving control by the controller 60 is the same as the above-described selection of the indoor unit 20 desired to execute power saving control during the cooling operation.

When the indoor unit 20 desired to execute power saving control is determined, the controller 60 executes power saving control upon the corresponding indoor unit 20.

First, the controller 60 judges whether or not a difference between the temperature of the space in which the indoor unit 20 desired to execute power saving control is installed, output from the temperature sensor 50 and a set temperature of the indoor unit 20 desired to execute power saving control is less than a reference value.

Since, if heating is underway, the indoor temperature is generally lower than the set temperature, the controller 60 judges whether or not a value obtained by subtracting the indoor temperature from the set temperature is less than the reference value. Here, the reference value is a value to judge an approximation degree of the indoor temperature to the set temperature, and for example, may be set to about 3° C.

If the difference between the indoor temperature and the set temperature is less than the reference value, the controller 60 lowers a target condensation temperature of the indoor unit 20 desired to execute power saving control. In more detail, the controller 60 lowers the target condensation temperature of the indoor heat exchanger provided at the indoor unit 20. Here, the target condensation temperature may be set to plural stages, each of which has a predetermined temperature range, and be stored, in the same manner as the above-described target evaporation temperature.

When the target condensation temperature is lowered, the controller 60 judges whether or not the condensation temperature of the indoor unit 20 is higher than the lowered target condensation temperature by comparing the condensation temperature of the indoor unit 20 with the lowered target condensation temperature.

If the condensation temperature of the indoor unit 20 is higher than the lowered target condensation temperature, the controller 60 lowers the condensation pressure c of the compressor 11, and thus reduces the capacity of the compressor 11 and reduces power consumption required to drive the compressor 11.

When the difference between the indoor temperature and the set temperature is less than the reference value, the indoor temperature normally approximates the set temperature, and thus it may be understood that little difference of warm air is felt by the user even if power consumption required in heating is reduced so as to more weakly execute heating.

Therefore, the target condensation temperature of the indoor unit 20 is lowered, and the condensation pressure c of the compressor 11 is adjusted by comparing the condensation temperature of the indoor unit 20 with the lowered target condensation temperature, thereby reducing power consumption required to drive the compressor 11.

When the condensation temperature of the indoor unit 20 is higher than the lowered target condensation temperature, in order to match the condensation temperature of the indoor unit 20 with the target condensation temperature, the capacity of the compressor 11 is reduced by lowering the condensation pressure c of the compressor 11. When the capacity of the compressor 11 is reduced in such a manner, power consumption required to drive the compressor 11 is reduced, and thus power saving effects may be obtained.

Further, when the condensation temperature of the indoor unit 20 is lower than the lowered target condensation temperature, also in order to match the condensation temperature of the indoor unit 20 with the target condensation temperature, the capacity of the compressor 11 is increased by raising the condensation pressure c of the compressor 11.

That is, when the condensation temperature of the indoor unit 20 is higher than the target condensation temperature, it is judged that this situation requires power saving, and thus the capacity of the compressor 11 is reduced by lowering the condensation pressure c of the compressor 11 and power saving effects are obtained, and when the condensation temperature of the indoor unit 20 is lower than the target condensation temperature, the capacity of the compressor 11 is increased by raising the condensation pressure c of the compressor 11 and thus indoor warm air is maintained.

Figure 7:
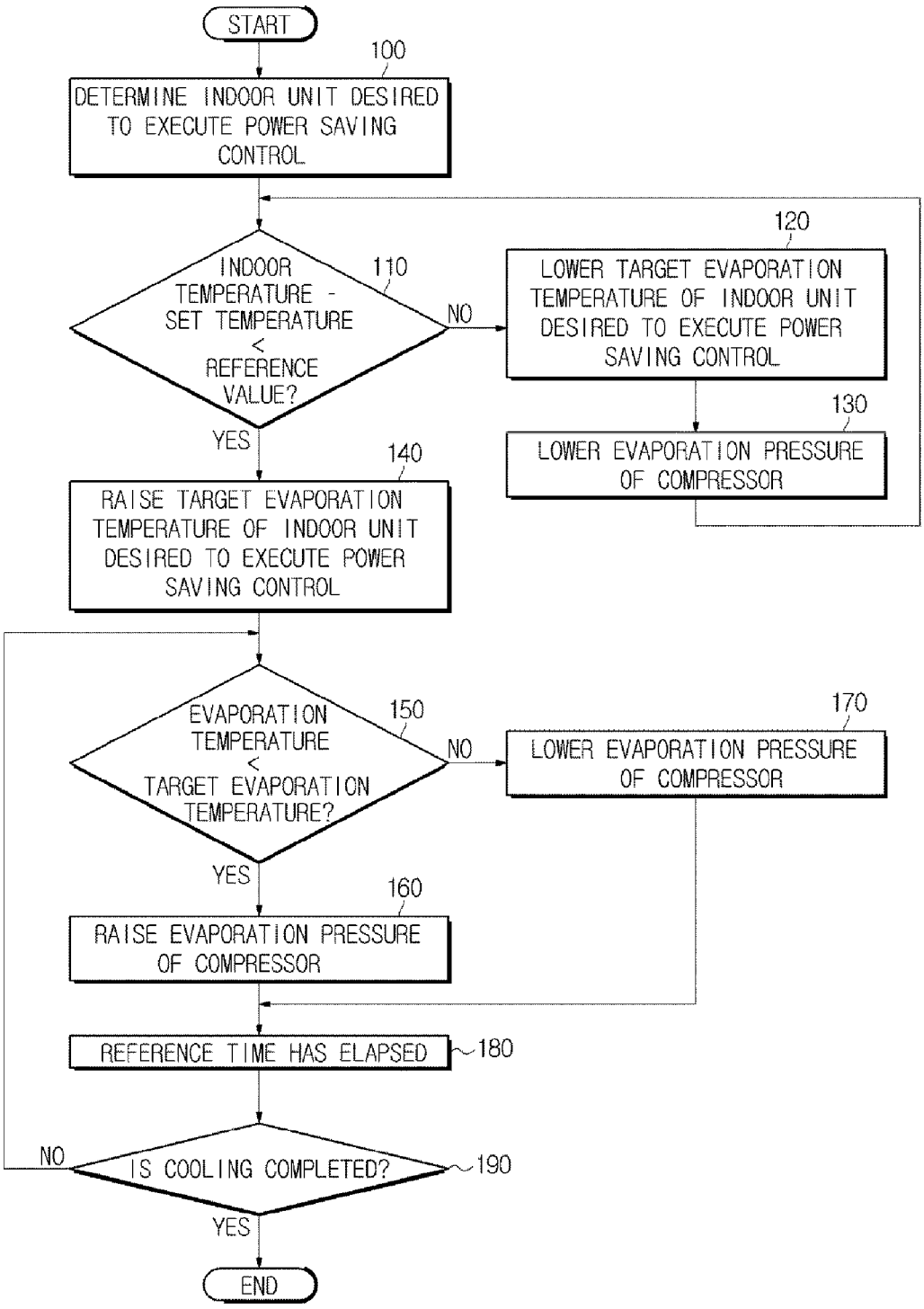
FIG. 7 is a flowchart illustrating a power saving control method of the multi type air conditioner in an embodiment during a cooling operation.

FIG. 7 is a flowchart illustrating a power saving control method of the multi type air conditioner in an embodiment during the cooling operation.

With reference to FIG. 7, first, the controller 60 determines the indoor unit 20 desired to execute power saving control (Operation 100).

When user instructions regarding the indoor unit 20 desired to execute power saving control among the plural indoor units 20 are input through the input unit 40, the controller 60 determines the indoor unit 20 desired to execute power saving control according to such instructions. Otherwise, as described above, the controller 60 may determine the indoor unit 20 desired to execute power saving control without user instructions transmitted from the input unit 40.

When the indoor unit 20 desired to execute power saving control is determined, the controller 60 executes power saving control upon the corresponding indoor unit 20.

The controller 60 judges whether or not a difference between a temperature of the space in which the indoor unit 20 desired to execute power saving control is installed, output from the temperature sensor 50 and a set temperature of the indoor unit 20 desired to execute power saving control is less than a reference value (Operation 110).

Since, if cooling is underway, the indoor temperature is generally higher than the set temperature, the controller 60 judges whether or not a value obtained by subtracting the set temperature from the indoor temperature is less than the reference value. Here, the reference value is a value to judge an approximation degree of the indoor temperature to the set temperature, and for example, may be set to about 3° C.

If the difference between the indoor temperature and the set temperature is greater than the reference value, the controller 60 judges that the indoor temperature does not yet approximate the set temperature, and thus does not execute power saving control and boosts cooling. That is, the controller 60 lowers a target evaporation temperature of the indoor unit 20 desired to execute power saving control (Operation 120), and for this purpose, lowers the evaporation pressure e of the compressor 11 to increase the capacity of the compressor 11 (Operation 130).

If the difference between the indoor temperature and the set temperature is less than the reference value, the controller 60 raises the target evaporation temperature of the indoor unit 20 desired to execute power saving control (Operation 140). Here, the target evaporation temperature may be set to plural stages, each of which has a predetermined temperature range, and be stored. For example, 5~7° C. may be set to a first-stage temperature range, 7~9° C. may be set to a second-stage temperature range, 9~11° C. may be set to a third-stage temperature range, 11~13° C. may be set to a fourth-stage temperature range, and the target evaporation temperature may be raised by raising the set stage. When the target evaporation temperature is raised, the temperature of air discharged from the indoor unit is raised, but since the indoor temperature already approximates the set temperature, little temperature variation is felt by the user and user discomfort due to discharge of excess cool air may be prevented.

When the target evaporation temperature is raised, the controller 60 judges whether or not the evaporation temperature of the indoor unit 20 is lower than the raised target evaporation temperature by comparing the evaporation temperature of the indoor unit 20 with the raised target evaporation temperature (Operation 150).

If the evaporation temperature of the indoor unit 20 is lower than the raised target evaporation temperature, the controller 60 raises the evaporation pressure e of the compressor 11 (Operation 160). By reducing the capacity of the compressor 11 by raising the evaporation pressure e of the compressor 11, power consumption required to drive the compressor 11 is reduced.

That is, when the difference between the indoor temperature and the set temperature is less than the reference value, the indoor temperature normally approximates the set temperature, and thus it may be understood that little difference of comfortableness is felt by the user even if power consumption required in cooling is reduced so as to more weakly execute cooling.

Therefore, the target evaporation temperature of the indoor unit 20 is raised, and the evaporation pressure e of the compressor 11 is adjusted by comparing the evaporation temperature of the indoor unit 20 with the raised target evaporation temperature, thereby reducing power consumption required to drive the compressor 11.

When the evaporation temperature of the indoor unit 20 is lower than the raised target evaporation temperature, in order to match the evaporation temperature of the indoor unit 20 with the target evaporation temperature, the capacity of the compressor 11 is reduced by raising the evaporation pressure e of the compressor 11. When the capacity of the compressor 11 is reduced in such a manner, power consumption required to drive the compressor 11 is reduced, and thus power saving effects may be obtained.

Further, when the evaporation temperature of the indoor unit 20 is higher than the raised target evaporation temperature, in order to match the evaporation temperature of the indoor unit 20 with the target evaporation temperature, the evaporation pressure e of the compressor 11 is lowered (Operation 170).

By increasing the capacity of the compressor 11 by lowering the evaporation pressure e of the compressor 11, the flow rate of the refrigerant may be increased and thereby, the evaporation temperature of the indoor unit 20 may match the target evaporation temperature.

That is, the raised target evaporation temperature serves as a reference to select priority among power saving and user comfortableness. When the evaporation temperature of the indoor unit 20 is lower than the target evaporation temperature, it is judged that this situation requires power saving, and thus the capacity of the compressor 11 is reduced by raising the evaporation pressure e of the compressor 11 and power saving effects are obtained, and when the evaporation temperature of the indoor unit 20 is higher than the target evaporation temperature, it is judged that this situation influences user comfortableness, and thus the capacity of the compressor 11 is increased by lowering the evaporation pressure e of the compressor 11 and user comfortableness is maintained.

After adjustment of the evaporation pressure e of the compressor 11 by comparing the evaporation temperature with the target evaporation temperature (Operations 160 and 170) is completed, when a predetermined reference time has elapsed (Operation 180), whether or not cooling is completed is judged (Operation 190), and upon judging that cooling is continued, the method returns to Operation 150 of comparing the evaporation temperature with the target evaporation temperature and then the subsequent operations are repeated. That is, a process of adjusting the evaporation pressure e of the compressor 11 by comparing the evaporation temperature with the target evaporation temperature at intervals of a regular period is repeated while cooling is continued.

Figure 8:
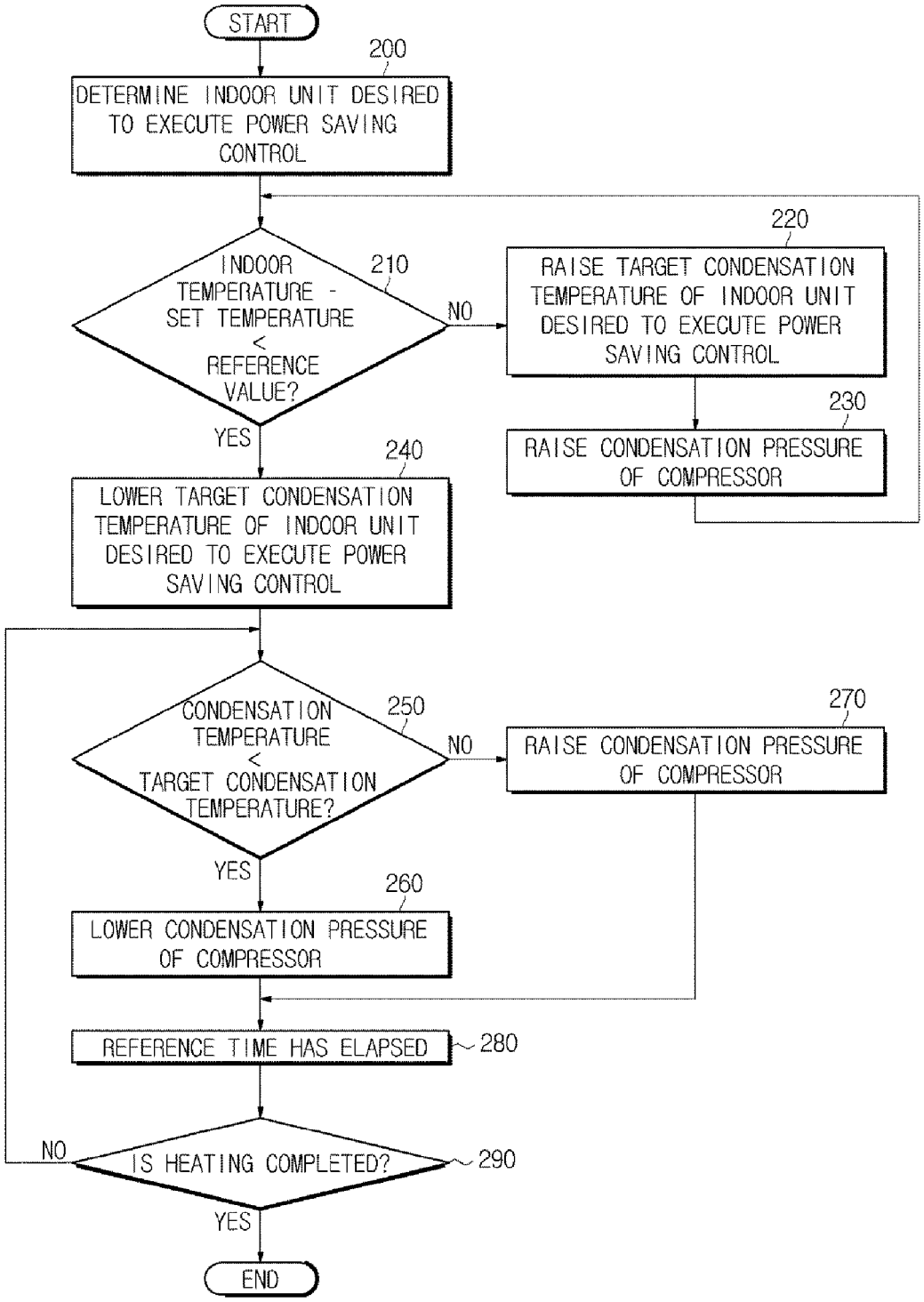
FIG. 8 is a flowchart illustrating a power saving control method of the multi type air conditioner in an embodiment during a heating operation.

FIG. 8 is a flowchart illustrating a power saving control method of the multi type air conditioner in an embodiment during the heating operation.

With reference to FIG. 8, first, the controller 60 determines the indoor unit 20 desired to execute power saving control (Operation 200).

When user instructions regarding the indoor unit 20 desired to execute power saving control among the plural indoor units 20 are input through the input unit 40, the controller 60 determines the indoor unit 20 desired to execute power saving control according to such instructions. Otherwise, as described above, the controller 60 may determine the indoor unit 20 desired to execute power saving control without user instructions transmitted from the input unit 40.

When the indoor unit 20 desired to execute power saving control is determined, the controller 60 executes power saving control upon the corresponding indoor unit 20.

The controller 60 judges whether or not a difference between a temperature of the space in which the indoor unit 20 desired to execute power saving control is installed, output from the temperature sensor 50 and a set temperature of the indoor unit 20 desired to execute power saving control is less than a reference value (Operation 210).

Since, if heating is underway, the indoor temperature is generally lower than the set temperature, the controller 60 judges whether or not a value obtained by subtracting the indoor temperature from the set temperature is less than the reference value. Here, the reference value is a value to judge an approximation degree of the indoor temperature to the set temperature, and for example, may be set to about 3° C.

If the difference between the indoor temperature and the set temperature is greater than the reference value, the controller 60 judges that the indoor temperature does not yet approximate the set temperature, and thus does not execute power saving control and boosts heating. That is, the controller 60 raises a target condensation temperature of the indoor unit 20 desired to execute power saving control (Operation 220), and for this purpose, raises the condensation pressure c of the compressor 11 to increase the capacity of the compressor 11 (Operation 230).

If the difference between the indoor temperature and the set temperature is less than the reference value, the controller 60 lowers the target condensation temperature of the indoor unit 20 desired to execute power saving control (Operation 240). Here, the target condensation temperature may be set to plural stages, each of which has a predetermined temperature range, and be stored, in the same manner as the above-described target evaporation temperature.

When the target condensation temperature is lowered, the temperature of air discharged from the indoor unit 20 is lowered, but since the indoor temperature already approximates the set temperature, little temperature variation is felt by the user and user discomfort due to discharge of excess warm air may be prevented.

When the target condensation temperature is lowered, the controller 60 judges whether or not the condensation temperature of the indoor unit 20 is higher than the lowered target condensation temperature by comparing the condensation temperature of the indoor unit 20 with the lowered target condensation temperature (Operation 250).

If the condensation temperature of the indoor unit 20 is higher than the lowered target condensation temperature, the controller 60 lowers the condensation pressure c of the compressor 11 (Operation 260). By reducing the capacity of the compressor 11 by lowering the condensation pressure c of the compressor 11, power consumption required to drive the compressor 11 is reduced.

When the difference between the indoor temperature and the set temperature is less than the reference value, the indoor temperature normally approximates the set temperature, and thus it may be understood that little difference of warm air is felt by the user even if power consumption required in heating is reduced so as to more weakly execute heating.

Therefore, the target condensation temperature of the indoor unit 20 is lowered, and the condensation pressure c of the compressor 11 is adjusted by comparing the condensation temperature of the indoor unit 20 with the lowered target condensation temperature, thereby reducing power consumption required to drive the compressor 11.

When the condensation temperature of the indoor unit 20 is higher than the lowered target condensation temperature, in order to match the condensation temperature of the indoor unit 20 with the target condensation temperature, the capacity of the compressor 11 is reduced by lowering the condensation pressure c of the compressor 11. When the capacity of the compressor 11 is reduced in such a manner, power consumption required to drive the compressor 11 is reduced, and thus power saving effects may be obtained.

Further, when the condensation temperature of the indoor unit 20 is lower than the lowered target condensation temperature, in order to match the condensation temperature of the indoor unit 20 with the target condensation temperature, the condensation pressure c of the compressor 11 is raised (Operation 270).

By increasing the capacity of the compressor 11 by raising the condensation pressure c of the compressor 11, the flow rate of the refrigerant may be increased and thereby, the condensation temperature of the indoor unit 20 may match the target condensation temperature.

That is, when the condensation temperature of the indoor unit 20 is higher than the target condensation temperature, it is judged that this situation requires power saving, and thus the capacity of the compressor 11 is reduced by lowering the condensation pressure c of the compressor 11 and power saving effects are obtained, and when the condensation temperature of the indoor unit 20 is lower than the target condensation temperature, the capacity of the compressor 11 is increased by raising the condensation pressure c of the compressor 11 and thus indoor warm air is maintained.

After adjustment of the condensation pressure c of the compressor 11 by comparing the condensation temperature with the target condensation temperature (Operations 260 and 270) is completed, when a predetermined reference time has elapsed (Operation 280), whether or not heating is completed is judged (Operation 290), and upon judging that heating is continued, the method returns to Operation 250 of comparing the condensation temperature with the target condensation temperature and then the subsequent operations are repeated. That is, a process of adjusting the condensation pressure c of the compressor 11 by comparing the condensation temperature with the target condensation temperature at intervals of a regular period is repeated while heating is continued.

As is apparent from the above description, a multi type air conditioner and a cooling and heating control method thereof in an embodiment prevent excess cool air or warm air from being discharged from an indoor unit desired to execute power saving control if the current temperature of the indoor unit desired to execute power saving control approximates a set temperature, thereby increasing comfortableness felt by a user.

Further, during cooling or heating of the indoor unit desired to execute power saving control, the capacity of a compressor is controlled according to an approximation degree of the indoor temperature to the set temperature, thereby obtaining power saving effects.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A multi type air conditioner comprising:

plural indoor units;

a compressor which compresses a refrigerant supplied to the plural indoor units;

a controller configured to determine an indoor unit desired to execute power saving control among the plural indoor units;

the controller configured to judge whether or not a difference between a temperature of a space in which the desired indoor unit is located and a set temperature of the desired indoor unit is less than a reference value; and the controller configured to raise a target evaporation temperature of the desired indoor unit upon determining the desired indoor unit and judging that the difference is less than the reference value, compare an evaporation temperature of the desired indoor unit with the raised target evaporation temperature, and control an operating pressure of the compressor to reduce capacity when the evaporation temperature of the desired indoor unit is lower than the raised target evaporation temperature.

2. The multi type air conditioner according to claim 1, further comprising an input unit configured to receive user instructions, wherein the controller is configured to determine the desired indoor unit according to user instructions input through the input unit.

3. The multi type air conditioner according to claim 2, wherein the input unit includes a wired or wireless remote controller, a computer loaded with a program for controlling operation of the multi type air conditioner, a smartphone loaded with an application for controlling operation of the multi type air conditioner, or a tablet personal computer (PC) loaded with the application for controlling operation of the multi type air conditioner.

4. The multi type air conditioner according to claim 1, wherein the target evaporation temperature of the desired indoor unit is set to plural stages, each of which has a predetermined temperature range, which is stored.

5. The multi type air conditioner according to claim 4, wherein the controller is configured to raise the stage of the target evaporation temperature of the desired indoor unit upon judging that the difference is less than the reference value.

6. The multi type air conditioner according to claim 1, wherein the controller is configured to control the operating pressure of the compressor to reduce capacity when the evaporation temperature of the desired indoor unit is higher than the raised target evaporation temperature.

7. The multi type air conditioner according to claim 1, wherein the controller is configured to compare the evaporation temperature of the desired indoor unit with the raised target evaporation temperature at intervals of a predetermined period.

* * * * *